United States Patent [19]

Reist

[11] 4,029,310

[45] June 14, 1977

[54] APPARATUS FOR FOLDING PRINTED PRODUCTS

[75] Inventor: Walter Reist, Hinwil, Switzerland

[73] Assignee: Ferag AG, Hinwil, Switzerland

[22] Filed: Mar. 25, 1976

[21] Appl. No.: 670,457

[30] Foreign Application Priority Data

Apr. 1, 1975 Switzerland ..... 4065/75

[52] U.S. Cl. ..... 270/63; 270/67; 270/68 R

[51] Int. Cl.[2] ..... B65H 45/16

[58] Field of Search ..... 270/61 R, 62, 63, 68 R, 270/70–77, 67, 32, 80–85, 4, 20

[56] References Cited

UNITED STATES PATENTS 3,905,592 9/1975 Spencer ..... 270/61 R

*Primary Examiner*—Edgar S. Burr
*Assistant Examiner*—A. Heinz
*Attorney, Agent, or Firm*—Werner W. Kleeman

[57] ABSTRACT

An apparatus for folding printed products comprising a revolving cell wheel with compartments, each for receiving a printed product to be folded. Each compartment has a folding blade driven to be displaceable to-and-fro between a work stroke and a return stroke. The folding blade, prior to the start of its work stroke, moves past a stationarily arranged folding rail common to all compartments and during the course of its work stroke has its side which trails, as viewed in the revolving direction, move past a contact rail or contact roll arranged in each of the compartments. Infeed means serve to deliver a printed product to the leading side of the folding blade prior to the start of its work stroke in each compartment.

22 Claims, 12 Drawing Figures

FIG. 6
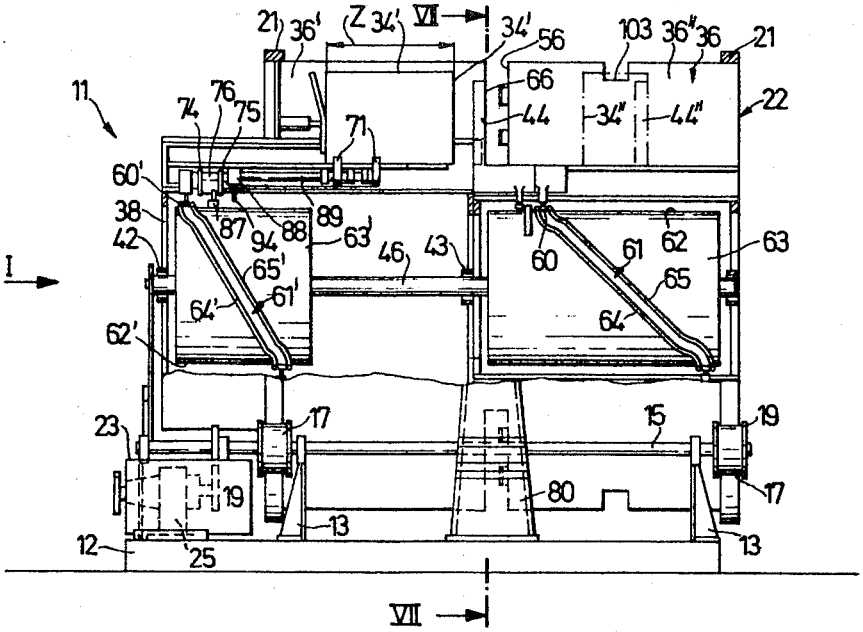
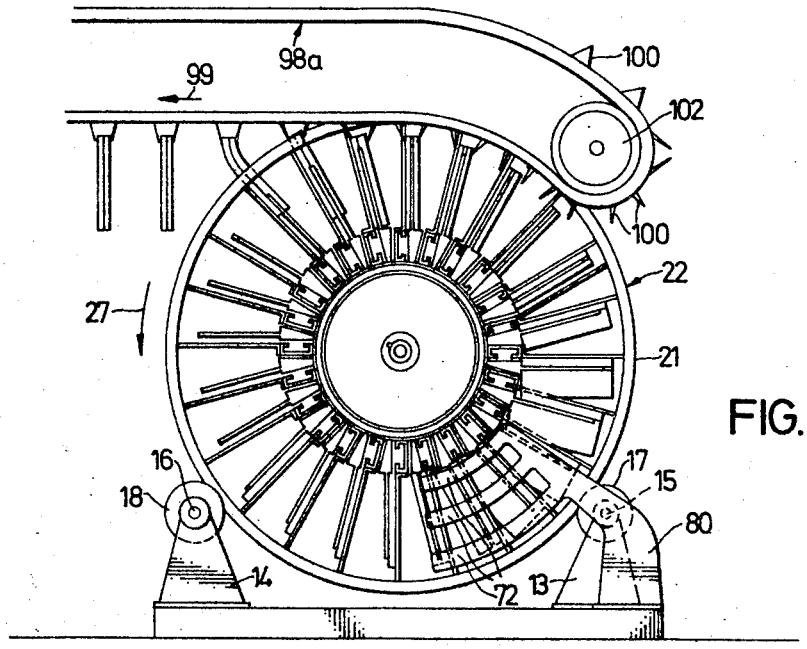
FIG. 7

APPARATUS FOR FOLDING PRINTED PRODUCTS

BACKGROUND OF THE INVENTION

The present invention relates to a new and improved construction of apparatus for folding products, especially printed products.

Folding devices are known to the art for the folding of printed products, as a general rule in the form of individual sheets, wherein the product to be folded is upset or otherwise appropriately acted upon so that it bows-out. Thereafter, the bowed-out portion is engaged by a clamping conveying gap, for instance appearing between two drums or between the confronting runs of two endless bands traveling in the same direction and there is simultaneously formed the fold. Encompassed within such species of folding devices are, for example, the so-called "pocket folding devices". As a general rule they are only suitable for individual sheets or, however, very thin printed products, for instance printed articles in letter form.

Further known devices for folding of printed products are for instance mounted at printing presses, such as rotary printing presses. As to these type devices there are those which form a fold at the throughpassing printed paper, in other words before there is formed the actual printed product as an individual copy. Other folding devices which are used in the aforementioned environment possess folding blades or swords which suddenly force the printed product to be folded into a folding gap. Although the known devices are capable of also folding multi-sheet printed products, nonetheless the maximum number of sheets is limited, or however, the folding gap must at least be more or less accommodated in size to the thickness of the corresponding product to be folded.

In any event with the prior art devices it is only possible in each case to fold one printed product at a time, comparatively limiting the output or capacity of such equipment, expressed in the number of folds produced per unit of time.

SUMMARY OF THE INVENTION

Hence, it is a primary object of the present invention to provide an improved construction of apparatus for folding products, especially printed products, which is not associated with the aforementioned drawbacks and shortcomings of the prior art equipment.

Another and more specific object of the present invention aims at the provision of an apparatus of the previously mentioned type which possesses a considerably greater output than the prior art devices with less dependency upon the thickness (number of sheets) of the printed products.

In keeping with the foregoing objects it is a further objective of the invention to devise an apparatus wherein the time needed for folding of a single printed product is considerably less decisive for the output per unit of time, or stated in another way, the apparatus continuously simultaneously subjects a number of printed products to the folding operation.

Now in order to implement these and still further objects of the invention, which will become more readily apparent as the description proceeds, the apparatus of this development is manifested by the features that there is provided a driven revolving cell wheel having compartments which are constructed for the reception of a respective one of the printed products to be folded and possess a respective folding blade or sword displaceably driven to-and-fro in axial direction of the cell wheel between a work stroke and a return stroke. The folding sword, prior to the start of its work stroke, moves past a stationarily arranged folding rail which is common to all compartments and during the course of its work stroke moves with its side which trails with respect to the rotational or revolving direction past a contact rail or contact roll arranged in each of the compartments. Further, there are provided infeed means in order to deliver to the leading side or face of the folding blade a printed product prior to the start of its work stroke in each compartment.

BRIEF DESCRIPTION OF THE DRAWINGS

The invention will be better understood and objects other than those set forth above, will become apparent when consideration is given to the following detailed description thereof. Such description makes reference to the annexed drawings illustrating two exemplary embodiments of the invention and wherein:

FIG. 6 is a view, similar to the showing of FIG. 2, of a second exemplary embodiment of the invention;

FIG. 7 is a simplified sectional view, taken substantially along the line VII—VII of FIG. 6;

DETAILED DESCRIPTION OF THE INVENTION

Prior to describing the invention in detail, it is here remarked that in the description to follow there will be considered on the basis of the drawings two exemplary embodiments of apparatus for folding printed products as contemplated by the invention. The sequence of the Figures has been selected such that in FIGS. 1 to 5 there is illustrated an embodiment which produces at the printed products a fold extending parallel to the axis of the cell wheel, whereas in the showing of FIGS. 1 and 6 to 12 there is portrayed a constructional embodiment producing a fold extending radially relative to the axis of the cell wheel.

Figure 1:
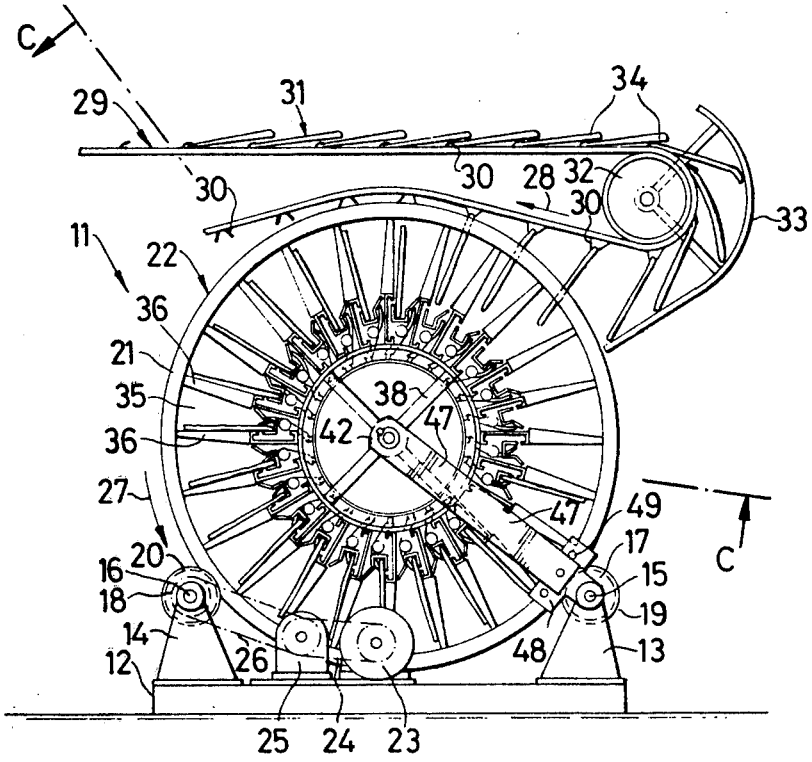
FIG. 1 is a simplified end view of both embodiments of the invention, viewed approximately in the direction of the arrow I of either the embodiment of FIG. 2 or the embodiment of FIG. 6.
Figure 2:
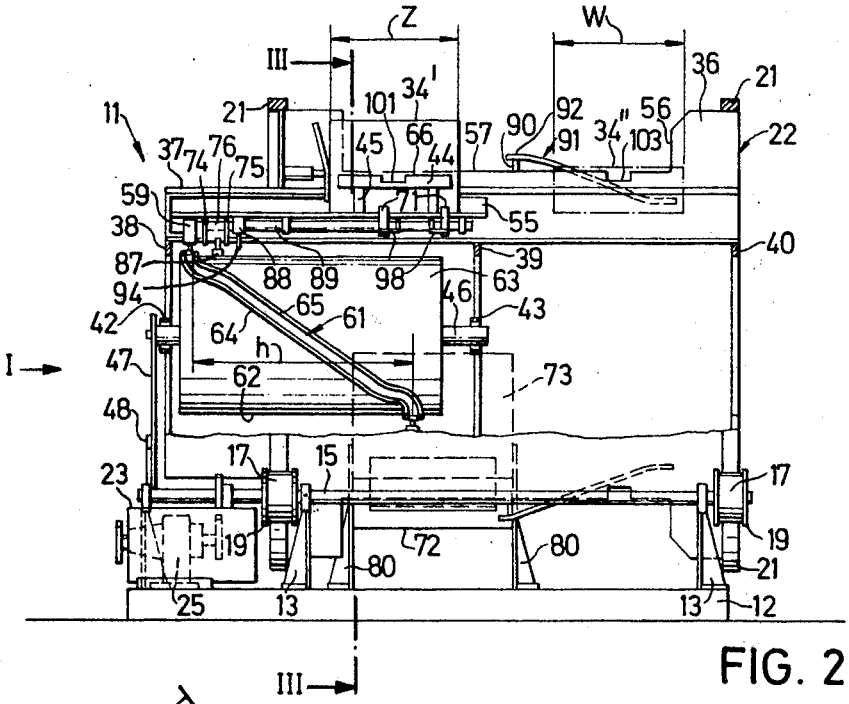
FIG. 2 is a side view, partially in section, of the first exemplary embodiment of apparatus for folding printed products.

Referring now specifically to FIGS. 1 and 2 (as well as FIG. 6) the apparatus 11 shown in a simplified total portrayal will be understood to possess a substantially rectangular base plate 12. Along both lengthwise extending sides of the base plate 12 there are mounted thereon, at essentially equidistant spacing, the bearing block 13, 14 in which there are mounted the respective shafts 15, 16 in the manner of transmission shafts. Seated at the same elevation upon these shafts 15 and 16 are rotatable support rolls 17 and 18, respectively, which are provided at both of their end surfaces with flanges or rims 19 and 20 respectively. Upon the contact surfaces of the support rolls or rollers 17, 18 there travel screw collar rings 21 or equivalent structure which hold together the sections of a cell wheel, generally designated in its entirety by reference character 22.

Secured to the base plate 12 is a drive motor 23 which, through the agency of a chain 24, reduction gearing 25 and a chain 26, drives at least the support roll or roller 18 appearing at the left-hand side of FIG. 1. But, it should be understood that all of the support rolls seated upon the shaft 16 could be driven. The contact surface of the driven support roll 18 can be provided with teeth and can mesh with corresponding teeth provided at the periphery of the associated screw collar ring 21, for instance in the manner of a mangle gear. To preserve clarity in illustration such tooth structure has not been shown in the drawings of FIGS. 1 and 2. From what has been explained above it will be apparent that the cell wheel 22, the different constructional manifestations of which will be described more fully hereinafter, is driven in the direction of the arrow 27, the drive force or driving power engaging at the circumference of the cell wheel 22.

The upper region of the periphery or circumference of the cell wheel 22 is spanned at the section (infeed location) designated by reference character Z in FIG. 2 by the end of a feeder or infeed conveyor 29 driven in the direction of the arrow 28. This conveyor 29 is equipped at a uniform spacing along 34 of an imbrecated product stream 31 resposing upon the upper run of such feeder or conveyor 29. the extent thereof with controlled grippers 30, each of which fixedly hold the associated trailing edge of a printed product 34 of an imbricated product stream 31 reposing upon the upper run of such feeder or conveyor 29. The conveyor 29 is guided about a deflecting roll or roller 32 surrounded by a guide member 33, for instance a sheet metal guide. During the course of the deflection of the conveyor 29 about the deflecting roll 32 the printed products 34 are moved out of the imbricated product stream 31, their leading edges slide along the inside of the sheet metal guide or guide member 33 and then hang downwardly from the run of the conveyor 29 which travels-off of the deflecting roll 32, as shown in FIG. 1. In this condition the printed products 34 penetrate into the compartments 35 of the cell wheel 22, and thereafter the grippers 30 are opened by any suitable and therefore not particularly illustrated means, so that the printed products 34 fall under the action of their own weight each into a compartment of the cell wheel 22. It should be realized that the speed of travel of the conveyor 29 as well as the equipping of such conveyor with grippers 30 and the rotational speed of the cell wheel 22 are accommodated to one another such that the passing movement of the compartments with respect to the grippers is synchronous and in-phase. It should also be apparent that the infeed location Z can have arranged upstream thereof a different infeed device than the illustrated conveyor 29, for instance a so-called press feeder which has the capability of inserting a printed product into each of the compartments in synchronism with the movement of the compartments. This can be accomplished both in axial as well as in radial direction. In the embodiment under discussion the printed products, after their introduction into the associated compartment, assume the position indicated by the outline 34' of FIG. 2 and 6 respectively.

From the showing of FIG. 1 it will be apparent that the illustrated cell wheel 22 possesses 24 compartments or cells. Consequently, in order to receive an arriving quantity of, for instance, 35,000 copies per hour the cell wheel 22 need only carry out about 25 revolutions per minute, and with an infeed rate of 80,000 copies per hour only about 56 revolutions per minute. Such rotational speeds can be readily realized in practice, even in the case of wheels having a diameter of about 1.6 meters (as in the case here). As will become further evident as the description proceeds, with the illustrated apparatus there is available for the introduction of the printed products into the cell wheel, for the folding thereof and for the removal from the cell wheel, considerably more time than the cell wheel requires for a single revolution.

Figure 3:
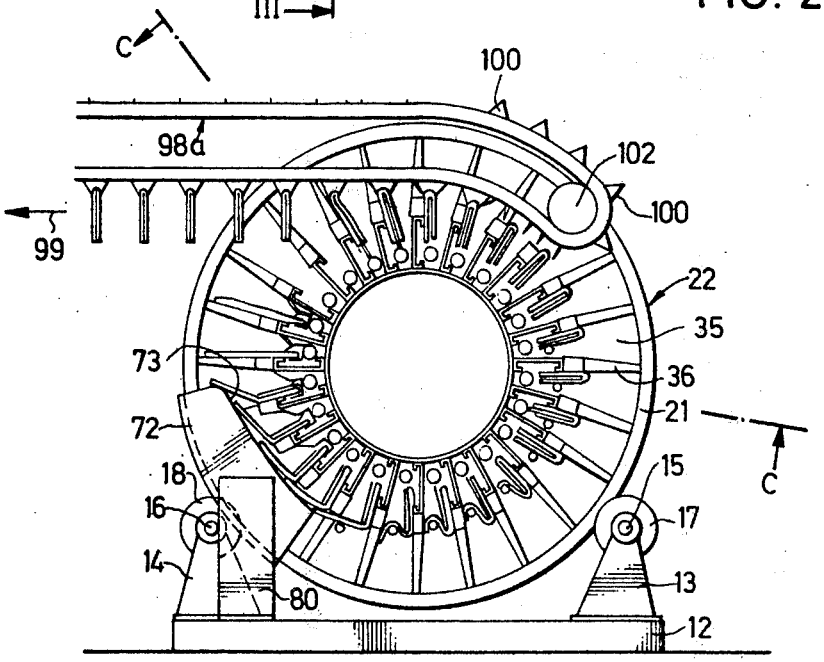
FIG. 3 is a simplified sectional view, taken substantially along the line III—III of FIG. 2.
Figure 4:
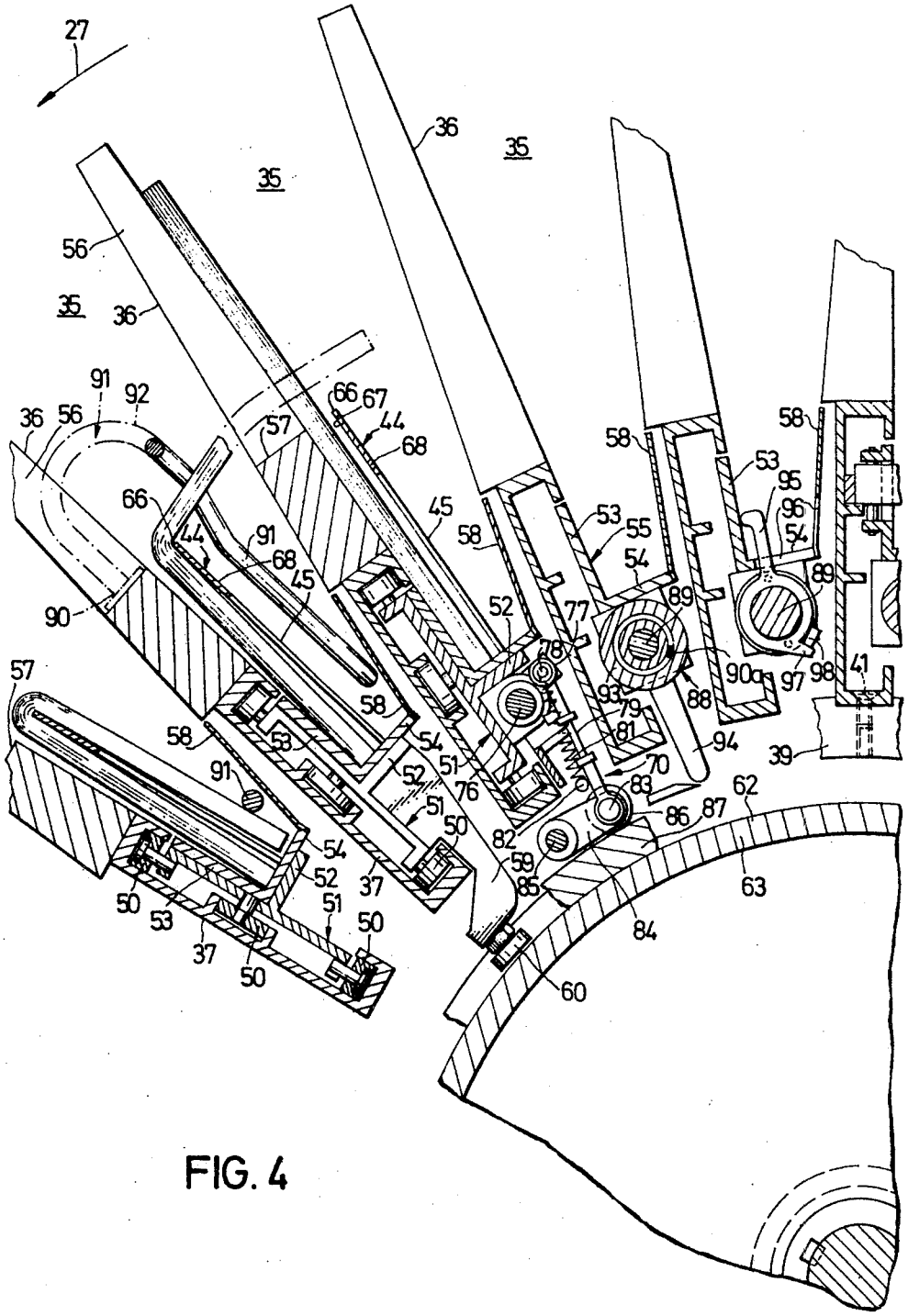
FIG. 4 is an enlarged sectional view through individual compartments of the cell wheel, the sectional planes being axially offset from compartment to compartment, and in individual compartments there have been omitted certain of the components for the sake of improving the showing of the drawings.

Reference is now further made to FIGS. 2 to 4 from which there will be apparent the construction of the cell wheel 22. The compartments 35 of the cell wheel 22 are laterally bounded by the partition walls 36, wherein the one side or face of one of the partition walls 36 bounds the one compartment and the other side of the same partition wall the neighboring compartment. As illustrated in FIG. 2 the partition walls 36 extend almost over the entire length of the cell wheel 22. At its side closer to the axis of rotation of the cell wheel each of the partition walls 36 is anchored, for instance by means of bolts or rivets, at the outside or outer surface of one leg of an essentially C-shaped profile rail 37 (FIG. 4).

The profile or structural rails 37 essentially extend over the entire length of the cell wheel 22 and in turn are anchored at a uniform spacing at the outside of the their other leg at the periphery of support wheels 38, 39 and support rings 40, anchoring being accomplished for instance with the aid of countersunk screws or bolts 41 or equivalent structure (FIG. 4). The hubs 42 and 43 of the support wheels 38 and 39, respectively, are rotatably mounted by means of ball bearings, respectively, upon a support shaft or axle 46 which thus is only supported via the support wheels 38 and 39 and the cell wheel 22.

The support axle 46 is secured against rotation by means of an arm or cantilever 47 keyed to one end of such support axle 46. The free end of the arm or cantilever 47 is pinned or otherwise attached with an apertured segment 48 having a number of bores or holes 49, so that in this way it is possible to adjust and fix the support axle 46 in its relative rotational position. As to the further function of the support shaft or axle 46 the same will be considered hereinafter.

By referring to FIG. 4 it will be apparent that the profile rails 37 not only serve for anchoring the partition walls, but also for guiding a carriage 51 equipped with a number of rollers 50 engaging with the profile rail 37 and traveling therein. Carriage 51 possesses a support flange 52 formed thereat and protruding from the profile rails 37. At the carriage 51 and at the support flange 52 there is secured, for instance, by means of bolts or equivalent structure, the outside of a respective one of both legs 53, 54 of a profile element 55 having a substantially L-shaped cross-sectional configuration. As best seen by referring to FIG. 2 the length of the profile elements 55 is smaller than that of the profile rails 37 and also smaller than that of the partition walls 36. The profile elements 55 thus can be displaced along the profile rails 37. In order to insure for a faultless guiding action guide brackets can be secured at a uniform spacing from one another at the outside or outer surface of the leg 53 of each of the profile elements 55, these guide brackets being equipped with rollers (not shown), but similar to the rollers 50, and engaging with the profile rails.

The inner surface or inside of the leg 53 of each profile element 55 is in alignment with the one side or face of the partition wall secured at the same profile rail 37, and at the free end edge of the leg 54 of the profile element 55 there is secured a guide member 58, for instance formed of sheet metal, and having a slightly bent cross-section. The face or side of the guide member 58 confronting the profile element 55 is in alignment with the other side of the neighboring partition wall 36 (FIG. 4).

Each of the profile elements 55 together with the guide member 58 secured thereat bounds or delimits the floor region of the associated compartment 35, this floor being displaceable in axial direction of the cell wheel 22.

For accomplishing the drive of this axial displacement there is provided at each of the carriages 51 a radially inwardly extending, rather massive arm or cantilever 59, at the inner end of which there is rotatably mounted a follower roller or roll 60 about a shaft which is radially directed with respect to the rotational axis of the cell wheel 22. The roll 60 engages with a small amount of play as a follower element at the flanks of a guide track designated by reference character 61 in FIGS. 2 and 3. The flanks of said guide tracks 61 are formed by two round or circular profile members 64, 65 secured, for instance by welding, to the outer jacket surface 62 of a cylinder drum 63. The substantially circular or round profile members 64 and 65 extend essentially in parallelism. Viewed in space these round profile members 65, 65 possess approximately the shape of an ellipse which bears at the cylindrical jacket surface 62, so that the guide track 61 describes an endless or closed curve which extends from one end of the drum 63 to its other end and after wrapping once around the drum again extends back to its one end. The drum 63 is supported at both ends at a respective disk (not shown), the disks are rigidly fastened at the disk centers by means of keys or wedges (not shown) or other suitable structure to the support axle.

The drum 63 and thus the guide track 61 are therefore stationarily arranged although their relative rotational position can be adjusted and fixed to a limited extent by the adjustment of the anchoring of the arm or cantilever 47 at the apertured segment 48. Since each of the rollers or rolls 60 is always in engagement with the guide track 61, the same and along with it the associated carriage 51 and the components secured thereat namely, the profile element 55 and the guide member 58, in other words practically the floor or bottom of each of the compartments 35 carries out, during the course of a rotation of the cell wheel 22, a work stroke amd a return stroke by an amount conveniently designated by reference character *h* in FIG. 2. It should be apparent that the speed with which there is carried out the work stroke and the return stroke as well as the residence or dwell time at the end of one of such strokes (dead-center point) is dependent upon the shape of the spatial curve described by the guide track 61. Hence, it is possible to distribute the work stroke and/or the return stroke over a greater or smaller angular range of one revolution of the cell wheel, and still to increase or decrease the dwell times at the end of such stroke within certain limits. In FIG. 2 the guide track 61 has been illustrated for the sake of simplicity in such a manner that during throughpassage of the visible side from the top towards the bottom there is carried out the work stroke. However, this need not of necessity be so. In reality it is advantageous if the work stroke, and therefore the axial displacement of the printed products occurs approximately during the passage through the compartments 36 below the rotational axis of the cell wheel 22, for instance in that sector which has been designated by reference character C—C in FIGS. 1 and 3.

An axial shifting or displacement of the printed products in the compartments 35 is not yet possible with sufficient accuracy merely due to the axial displacement of the profile element 55 with the guide member 58, because the printed products during the course of the rotation of the cell wheel also bear with frictional contact at the side or face of the axially non-movable partition walls 36, apart from the fact that the printed products could fall out of the compartments. Hence, for each compartment 35 there are provided entrainment means embodying griplers axially movable along with the profile element 55 and the guide member 58. In the exemplary embodiment under consideration there is provided one gripper set 71 (FIG. 2) which can be actuated by means of a drive mechanism 70 (FIG. 4).

As seen in FIG. 2 two bearing arms 74, 75 are attached at the carriage 51 below the support flange 52. Pivotably mounted in these bearing or support arms 74, 75, at the region of the support flange 52, is a pivotal or pivot shaft 76. A crank arm 77 is rigidly attached for rotation to the pivotal shaft 76 and at the free end of crank arm 77 there is articulated, at location 78, a lengthwise adjustable hinge rod 79 and one end of a traction or tension spring 81, the other end of which is anchored at a pin 82 protruding from the bearing or support arm 75. The lower end of the hinge rod 79 is hingedly connected at location 83 with the free end of a rocker or balance 84 which, in turn, is pivotable about a hinge pin 85 extending between the lower ends of the bearing or support arms 74, 75. At the free end of the rocker 84 there is additionally arranged a rotatable roller 86 which cooperates with a cam or dog 87 which in turn is secured to the jacket or outer surface 62 of the drum 63 at the region of the dead-center point of the guide track 61 appearing at the left-hand side of FIG. 2. The tension spring 81 thus brings about a pre-biasing of the roller 86 towards the drum 63 and the cam 87 this raises the roller 86 against the action of the tension spring, resulting in a rocking of the pivotal shaft 76 in the counterclockwise direction of FIG. 4.

The non-visib;e end of the pivotal shaft 76 which extends to the right of FIG. 2 past the support or bearing arm 75 is guided within an unlockable or releasable free-wheeling device 88 and at that location is rigidly coupled for rotation at a coaxial shaft journal or extension 89. The free-wheeling device 88 is of the type which normally allows rotation of the pivotal shaft 76 and thus the shaft extension 89 in the counterclockwise direction (FIG. 4) but blocks rotation in the clockwise direction. If the free-wheeling device 88 is unlocked then it allows rotation of the components 76 and 89 in both rotational directions. The free-wheeling device 88 can be a type of precision-spring coupling which has become known in the art under the designation "Curtiss-Wright" and commercially by Marquette Metal Products Co., Cleveland, Ohio and/or its licensees and in which coupling a spiral or helical spring is anchored at one end at one part or component to be coupled and is wrapped around the other part or component to be coupled. In the embodiment under discussion the one end of this spring is fixedly secured whereas the spring moreover frictionally wraps about both the shaft 76 as well as also the shaft journal or extension 89 or a not particularly shown but conventional wedge collar intercoupling both of these components.

With suitable selection of the sense of winding or coiling of the aforementioned spring the parts 76 and 89 can thus rotate in the one direction because then this spring has the tendency of increasing the inner diameter of its coils, resulting in the parts or components 76 and 89 being able to rotate internally of the spring. In the other rotational direction of the parts 76 and 89 the spring has the tendency of contracting its coils, producing a press fit of the spring upon the parts 76, 89 and along therewith a blocking of these parts because the one end of the spring is of course fixedly secured. On the other hand, the other end of the spring is secured internally of a control sleeve 93 which freely rotatably bears upon the outer diameter of the spring. Secured to the control sleeve 93 is an actuation arm 94. If this arm 94 is rocked in counterclockwise direction in FIG. 4, then the spring in any event is caused to enlarge the inner diameter of its coils, so that the parts 76 and 89 are freed for carrying out an unhindered rotation in both rotational directions.

It should be apparent from what has been discussed above that upon run-on of the roller 86 upon the cam 87 the pivotal shaft 76 and thus the shaft journal or extension 89 are rocked or pivoted, and blocked in the thus rocked position by the freewheeling device 88 as long as such is not unlocked by rotating the control sleeve 93. The tension spring 81 thus also cannot become effective at the end of the cam 87 and rotate back the parts 76 and 89 as long as the free-wheeling device 88 is effective. The advantageous consequence of this construction resides in the features that a very short construction of the cam 87 is possible and only serves for the rocking of the parts 76 and 89 in the one direction, i.e.—as will be shortly explained —for closing the grippers of the set 71, whereas the rotation of the parts 76 and 89 in the other direction, i.e. the opening of the grippers, under the action of the tension spring 81 is first then released due to the rotation of the control sleeve 93. The closing and opening of the grippers therefore occurs by two separate elements which accordingly also can be separately arranged and in principle independent of the guide track 61.

The gripper set 71 possesses two pivot or pivotal arms 95 rotatably mounted upon the shaft extension 89 and engage through slots 96 in leg 54 as well as in the sheet metal guide member 58 (FIG. 4, right-hand side). At the hub of the pivotal arm 95 surrounding the shaft extension or projection 89 there is formed a stop or impact nose 97 which coacts with a stop finger 98 fixedly connected with the shaft extension 89, and the pivotal arm 95 itself is pre-biased upon this stop finger 98 by means of a pre-biased spring (not shown) surrounding the shaft extension 89. Thus, if the shaft extension 89 is rocked in FIG. 4 in the counterclockwise direction, then the free end of the pivot arm 95 moves towards the leg 53, but can spring-back under the action of the pre-biased spring. A printed product bearing upon the leg 54 is thus clamped at the leg 53 independently of its thickness by means of the free end of the pivotal or pivot arms 95 and thus is brought to bear at the side wall of the associated partition wall which appears at the right of FIG. 4. Consequently, it will be seen that during the course of one revolution of the cell wheel 22 the printed products located in the compartments are axially advanced (work stroke) through a path corresponding to the distance *h* and the grippers thereafter again open and return to their starting position.

At this point there will be described the elements responsible for the folding operation. From the showing of FIGS. 2 and 4 there will be apparent that a folding blade or sword 44 is arranged upon the leg 54 of each of the profile elements 55 by means of two welded supports or braces 45. The folding blade 44 in turn possesses a folding edge 66 and, viewed in the direction of rotation (arrow 27) of the compartment 35, a leading side 67 and a trailing side 68. The folding blade 44 is secured approximately at the height of the gripper set 71 at the profile element 55 and the pivot arms 95 engage past the supports 45. To simplify the showing of FIG. 4 at both of the compartments appearing at the right thereof there have not been illustrated the folding blades. The folding blades 44 are thus displaceable as a unit together with the axial displaceable components of each of the compartments 35, namely together with the profile element 55, the guide member 58 and the gripper set 71.

From the showing of FIG. 2 it will be seen that at the lengthwise edge of all partition walls 36, and which lengthwise edge faces away from the axis of the cell wheel 22, there is machined or otherwise formed a cut-out or recess 56 which almost extends over the entire length of the partition walls 36. The floor of this cut-out 56 has been designated by reference character 57. It should thus be apparent that the free lengthwise edge of the printed product (outline 34') introduced into the cell wheel 22 and engaged by the gripper set 71, remains freely accessible during the rotation of the cell wheel. As best seen by referring to FIG. 3, engaging into the cut-out 56 is a folding rail 72 secured by means of supports 80 upon the base or socket 12 and the cylindrical concave curved guide surface 73 thereof which is essentially coaxial with respect to the axis of the cell wheel extends at a lesser spacing from the circle of movement of the folding edge 66 of the folding blade 44. This guide surface 73 thus engages into the path of movement of the printed product protruding past the cut-out 56, during such time as the printed product is axially advanced or shifted in the compartments 35 while being fixedly clamped by the gripper set 71. Thus, the printed products are bent about the folding edge 66 during the course of their axial displacement, as clearly shown in FIG. 3.

Still this does not however constitute termination of the folding operation. At the floor or base 57 of each of the cut-outs or recesses 56, and as best seen by referring to FIGS. 2 and 4, there is secured one end 90 of a folding bracket 91, defining pressure or contact means, which engages in an arc 92 over the axial path of movement of the folding edge 66 of the folding blade 44 arranged in the next following compartment 35—viewed in the direction of rotation 27—and thus in spaced relation to the trailing side 68 of this folding blade 44 extends at an inclination towards the end of its path of movement and towards the leg 54. This has been illustrated in FIG. 4 and in the second compartment at the left side thereof and in FIG. 2. The folding bracket 91 is formed in such a manner that its arc or curved portion 92 permits movement therebelow of the printed product folded by the guide surface 73 about the fold edge 66 during the axial shifting or displacement of such printed product, whereafter the inclined section of the folding bracket 91 which follows the arc 92 is pressed, towards the end of the axial displacement of the folded portion of the printed product, increasingly against the trailing side 68 of the folding sword 44 and thus terminates the folding operation. At the end of the folding operation the printed product assumes the position shown in phantom outline 34'' in FIG. 2 where it straddles over the folding sword 44 and is prepared to be removed from the cell wheel 22. Hence, the printed product during its residence time within the cell wheel describes a path which initially is circular, then helical, and finally again circular. For the removal of the folded printed products from the cell wheel 22, and as best seen by referring to FIG. 3, there is provided an endless outfeed conveyor 98, which may be similar to the conveyor 29, and which outfeed conveyor 98 is driven in the direction of the arrow 99 and is equipped at a uniform spacing with controlled grippers 100. The outfeed conveyor 98 spans over the cell wheel 22 through a region which has been designated by reference character W in FIG. 2. Once again the arrangement is carried out such that the division of the grippers of the conveyor 98 corresponds to the division of the cell wheel into compartments, so that the grippers 100 secured at the lower run of the outfeed conveyor 98 which travels-off of the deflecting roller 102, and as best seen by referring to FIG. 3, to a certain extent during its movement past engages the folded printed products at the fold, raises them from the folding blades 44 and removes them out of the compartments 35. To ensure that the grippers 100 of the outfeed conveyor 98 do not clamp the folding sword 44 there is provided in its fold or folding edge 66, a cut-out 101 which at the end of the work stroke is in alignment (FIG. 2) with a similar formed cut-out 103 at the floor 57 of the partition wall 36. After the removal of the printed products the axially displaceable components of each compartment 35 carry out the return stroke, and specifically, at a speed which is dependent upon the shape of the guide track 61 at the drum 63. At the end of the return stroke the gripper set 71 together with the folding sword 44 are ready to seize or engage a printed product which possibly already previously has been deposited into the relevant compartment 35 and to carry out the folding operation during the course of the work stroke.

Figure 5:
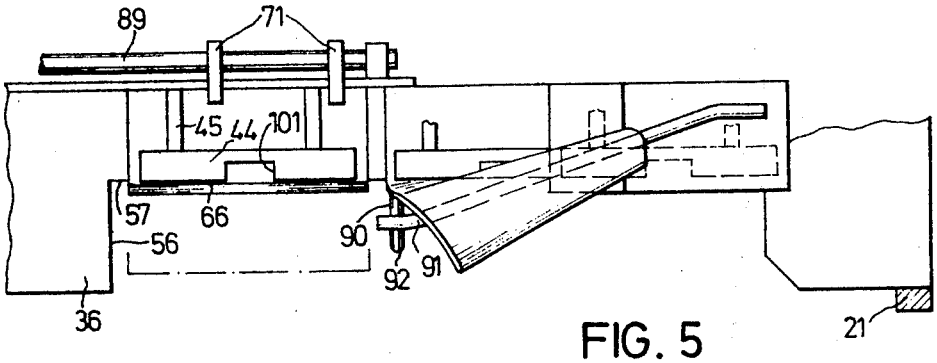
FIG. 5 is a simplified side view on an enlarged scale of a compartment of the apparatus according to the showing of FIGS. 2 to 4, there being illustrated the printed product located in such compartment at both the beginning and at the end of the folding operation.

Now in FIG. 5 for the purpose of clarifying the folding operation there have been simultaneously illustrated time-different phases of the folding operation occurring during the course of the axial displacement within a compartment 35, the same reference characters having been conveniently employed as for FIGS. 1 to 4. The difference resides in the fact that this folding operation is illustrated in one of the compartments which appears at the bottom of FIG. 3.

Thus, while on the basis of the showing of FIGS. 1 to 5 there has been described an exemplary embodiment of apparatus which produces a fold extending parallel or essentially parallel to the axis of the cell wheel 22, in conjunction with FIGS. 6 to 12 there now will be described in detail an exemplary embodiment of the invention which produces a fold extending at right-angles or radially with respect to the axis of the cell wheel 22. As a matter of convenience for the functionally corresponding components the same reference characters have been employed as for the embodiment of FIGS. 1 to 5, even if such components have a different form and configuration.

The essential differences of the variant embodiment of FIGS. 6 to 12 from the previously described embodiment of FIGS. 1 to 5, will initially be briefly summated: The folding edges 66 of the folding blades 44 extend at right-angles to the axis of the cell wheel 22. The folding blades or swords 44 are coupled through the agency of a special mechanism with the follower element 60 engaging with the guide track 61. Again there is provided for each compartment of the cell wheel 22 as the feed or advance elements a set 71 of grippers, which likewise are axially displaceable in the compartment in step with the folding blades 44, however with regard thereto with a phase shift and with a smaller length of stroke.

With the cell wheel 22 illustrated in FIG. 6 and the following Figures of the drawings, there will be recognized the drum 63 rigidly seated for rotation upon the support shaft 46 and at its jacket surface 62 the guide track 61 with both of the round or circular profiles or profile members 64, 65 between which engages the roller or roll 60 as follower element for the axial displacement of the folder blade or sword 44. The folding sword 44 illustrated at the top of Figure is in its right boundary position, i.e. shortly prior to the start of its work stroke, possesses a folding edge 66 which is disposed at right-angles to the lengthwise axis of the cell wheel. In this position the folding sword 44 bounds so-to-speak flushly at the side edge of the cut-out 56 of the associated partition wall 36 of the compartment, this side edge appearing at the left of FIG. 6. This cut-out 56, with this modified version of the apparatus, possesses a smaller width than for the embodiment of FIGS. 2 to 5, however, extends practically to the floor of the associated compartment. The partition walls 36 are thus subdivided by the cut-out 56 into a starting section 36' and a terminal or end section 36''. The construction of the gripper set 71 is the same as with the embodiment of FIGS. 2 to 4. This also will be clear from the showing of FIG. 8, which with respect to the sections illustrated for explaining the gripper mechanism is practically identical to that of FIG. 4. In this case the difference resides in the fact that the roller or roll 60′, which causes axial shifting or displacement of the gripper set 71, engages with a guide track 61′ which is formed by two circular profile member 64′, 65′ welded to the jacket or outer surface 62′ of a drum 63′ likewise seated upon the support shaft 46. The guide track 61′, as best seen by referring to FIG. 6, implements a smaller stroke of the gripper set 71 than the stroke imparted by the guide track 61 to the folding blades 44. Additionally, in reality both drums 63 and 63′ are keyed to the support shaft while rotated relative to one another in such a manner that the stroke movements of the gripper set in relation to that of the folding swords 44 occurs with a phase shift of about 180° relative to the rotational movement of the cell wheel 22. In FIG. 6 this turned or rotated position of the drums 63 and 63′ has not been particularly illustrated in order to simplify the showing of the drawings. At this point there is only still mentioned that the length of the work stroke of the gripper set 71 with the embodiment of FIGS. 6 to 12 is chosen such that the printed product (outline 34′) infed at the infeed region Z is displaced at the end of the work stroke of the gripper set to such an extent that the fold edge 66 of the folding blade 44 associated with the corresponding compartment comes to lie at the center of the format of the printed product.

As will be evident from the showing of FIG. 7 the folding rail 72 which is secured via the support 80 upon the base plate 12 possesses an approximately bifurcated or fork-shaped construction and engages into the cut-outs 56 in the partition walls 36, and which cut-outs are aligned with respect to one another.

At each of the starting sections 36′ of the axial non-displaceable partition walls 36 there is secured adjacent the cut-out 56 a sheet metal guide plate or guide member 104 (FIGS. 8 and 10) which constricts the throughpass cross-section of the associated compartment to a gap 105, the width of which is sufficient in order to guide through the printed products while engaged by the gripper set 71. One of the purposes of the guide member 104 is to force the printed product which has been axially displaced by the gripper set 71 to the side of the starting section 36′ appearing at the right of FIG. 8. A further purpose of this guide member 104 is to provide in the axial direction a type of "dead space", where the folding sword 44 can remain prior to the start of its work stroke, without there existing the danger that the leading edge of the axial shifting printed product will run onto the folding blade or sword.

Figure 10:
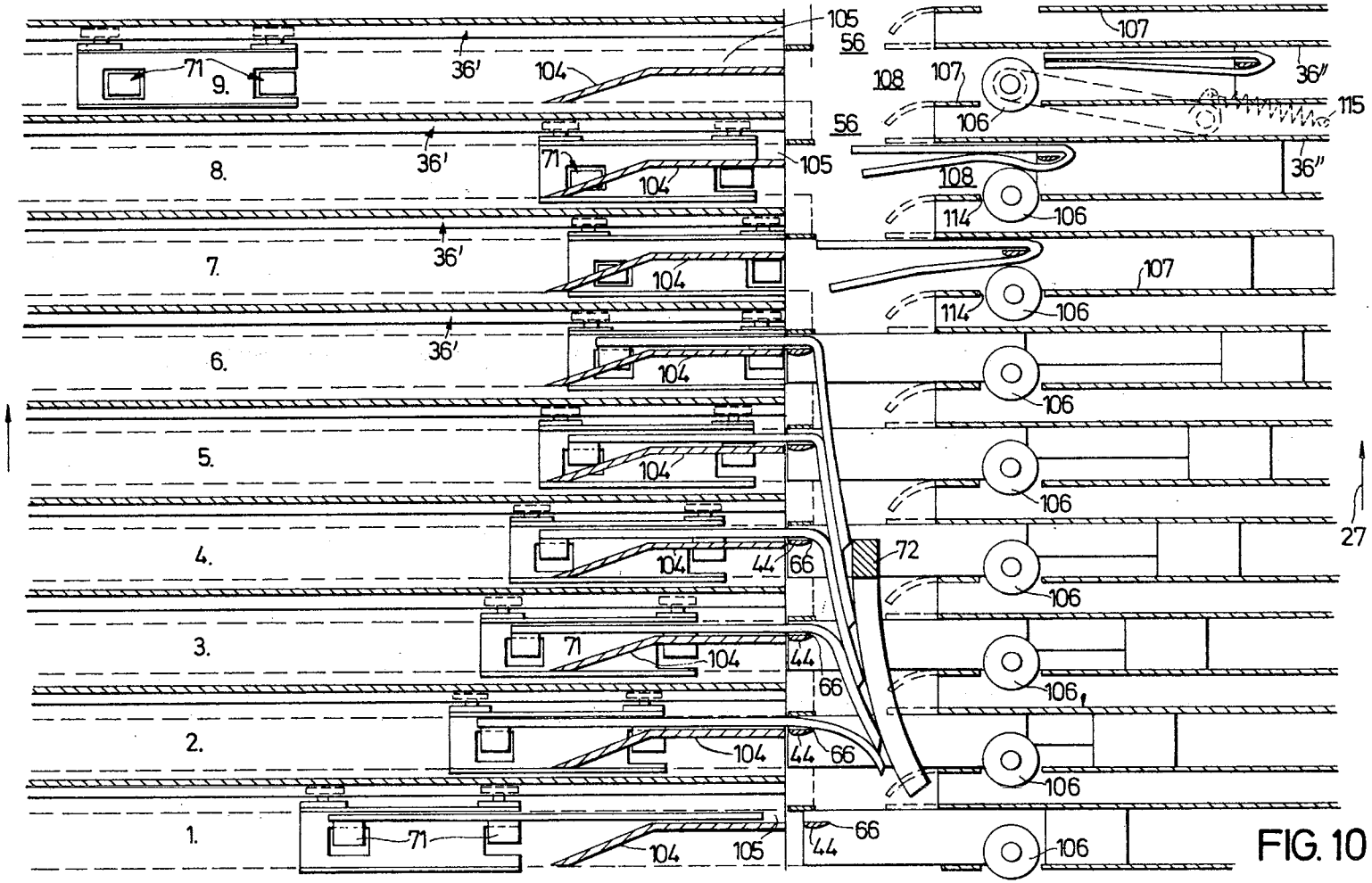
FIG. 10 generally is a development view looking in radial direction at the transition location from the starting region to the end or terminal region of those compartments of the cell wheel of the apparatus of FIGS. 6 to 9 where there is just being formed the fold during the course of their rotational or revolving movement.

Reference is now made to FIG. 10 which provides in development, radial views in successive compartments of the cell wheel 22, so that there are visible the different phases of the folding operation. There will be recognized from the bottom towards the top nine compartments, wherein from the left towards the right of the Figures there have been illustrated the starting section 36′ of the partition walls, then the cut-outs 56 in which engage the fold or folding rail 72 and the start of the end or terminal sections 36″ of the partition walls. The compartments move, corresponding to the rotational movement of the cell wheel 22, in the direction indicated by the arrow 27 in FIG. 10.

In the lowermost compartment there will be seen the folding blade or sword 44 which is approaching the end of its return stroke, whereas the gripper set 71 is in the process of forwardly advancing a printed product through the gap 105. The gripper set 71 thus approaches the end of its work stroke. In the second compartment from the bottom the folding blade 44 has reached the end of its return stroke and thus remains in the "shadows" of the guide member 104, whereas the printed product has been advanced past the folding edge 66 of the folding blade 44 and already runs onto the folding rail 72, so that it is bent about the folding edge 66. In the third, fourth, fifth and sixth compartments from the bottom this pre-folding operation continues and is completed in the sixth compartment. In this sixth compartment the gripper set 71 has reached the end of its work stroke and the printed product, which is still in engagement with the folding rail 72, is flexed through a maximum amount about the folding edge 66 of the associated folding blade or sword 44. The follower element 60 (see FIG. 6) engaging with the guide track 61 and associated with the folding blade 44, already began its work stroke from the second compartment from the bottom, the associated folding blade however initially remains arrested still at the starting point of its work stroke by means of a mechanism which will be described shortly, and a spring is prebiased. Upon transition from the sixth to the seventh compartment the grippers of the gripper set 71 open and at the same time the folding sword is released, so that it suddenly is spaced from the guide member 104 and while entraining the printed product moves past a contact or pressure element, here shown in the form of a contact roller or drum 106.

Each of the compartments is equipped with one such contact or pressure drum 106 which are axially non-displaceable. In the eighth compartment from the bottom also the gripper set 71 in its opened condition starts its return stroke and in the ninth compartment from the bottom is on its way to "retrieve" a new printed product which has been infed to the corresponding compartment. It is to be observed that the axial displacement of the printed product in the compartment only occurs in part by the gripper set 71, another part of such axial displacement however is carried out by the folding blade 44 itself. The end of the work stroke of the folding blade 44 has been designated by reference character 44″ in FIG. 6. The printed product which has now been halved in its format assumes, at the end of the work stroke of the folding blade 44, the position designated in FIG. 6 by the outline 34″ and therefore is located at the region of the recess or cut-out 103 where it is engaged by the grippers 100 of the outfeed conveyor 98 and removed from the cell wheel 22.

Figure 9:
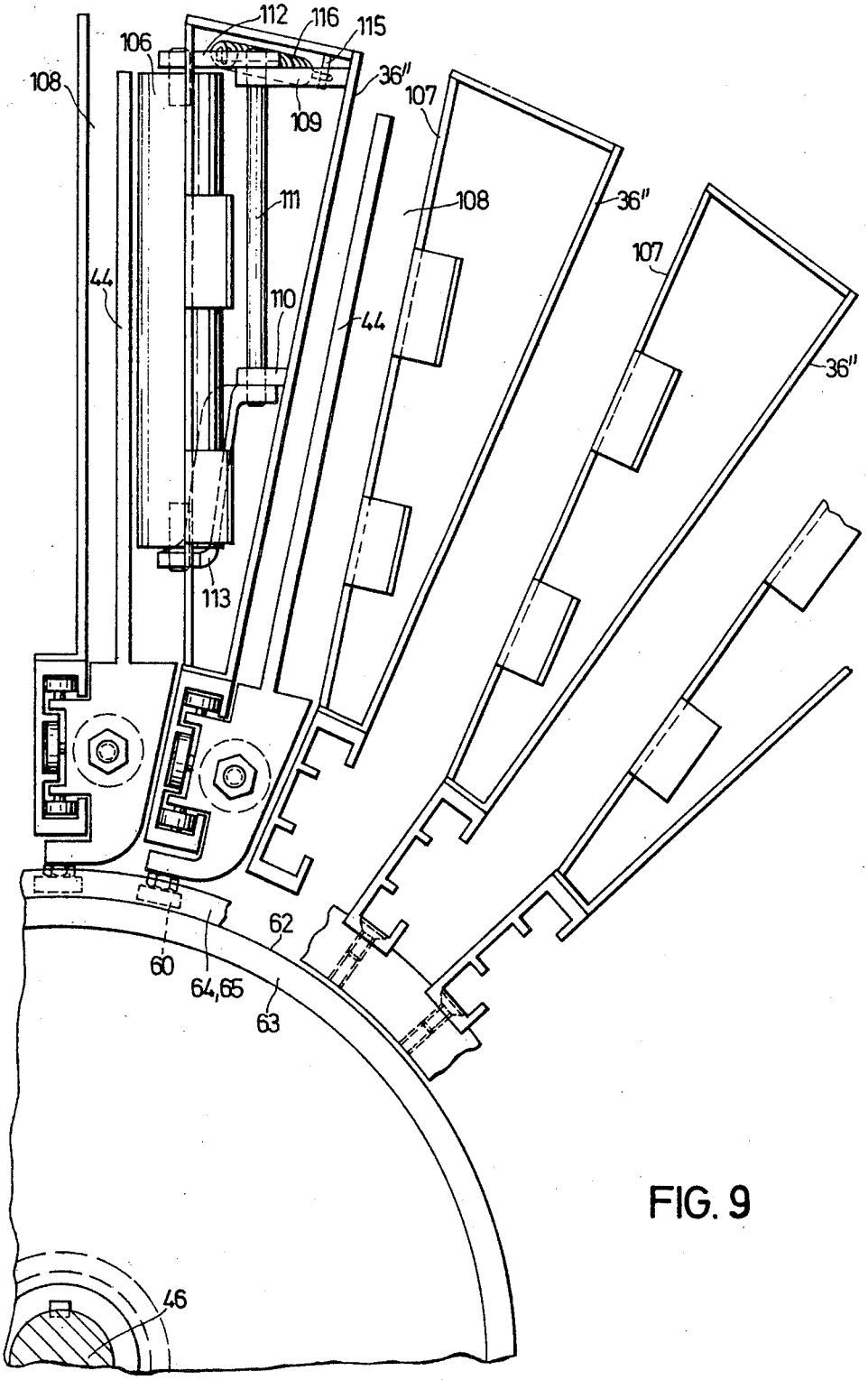
FIG. 9 likewise illustrates on an enlarged scale sections through the end region of individual compartments of the cell wheel of the apparatus according to FIGS. 6 and 7, wherein from compartment to compartment the sections have been axially offset and certain components omitted to preserve clarity in illustration.

As will be apparent from the showing of FIGS. 9 and 10 the passage through the compartments of the cell wheel 22 is also constricted to a throughpassage gap 108 at the region of the end section 36″ of the partition walls by means of a sheet metal guide plate or guide member 107 secured to one side of each such end section. The width of this throughpassage gap or space 108 amounts to somewhat more than twice the gap 105.

The associated folding blade 44 passes approximately centrally through this throughpassage gap 108. Two bearing brackets 109, 110 extend from the same side of each of the end sections 36″ and in the direction of the guide member 107 which is secured at the associated end section 36″, as best seen by referring to FIG. 9.

Rotatably mounted in such bearing brackets is a pivotal or pivot shaft 111, upon the free ends of which there is seated the respective one end of a balance or rocker 112, 113. Between the other ends of the balances 112, 113 there extends the already mentioned freely rotatable contact drum 106 which engages through a slot 114 in the guide member 107, this slot extending radially relative to the axis of the cell wheel. Additionally, there is provided a tension spring 116 secured at one end at the balance or rocker 109 and at the other end at location 15, the tension spring striving to force the balance 112 and therefore also the contact drum 106 and the balance 113 into the extended position, as such has been illustrated in the lower six compartments of FIG. 10. The contact drum 106 therefore only deflects the folding blade 44 which moves past together with the printed product and thus presses the printed product against the trailing side surface of the folding blade. In this regard the contact drum or roll 106 can be compared with the folding bracket 91 of the embodiment according to FIGS. 2 to 5.

Figure 11:
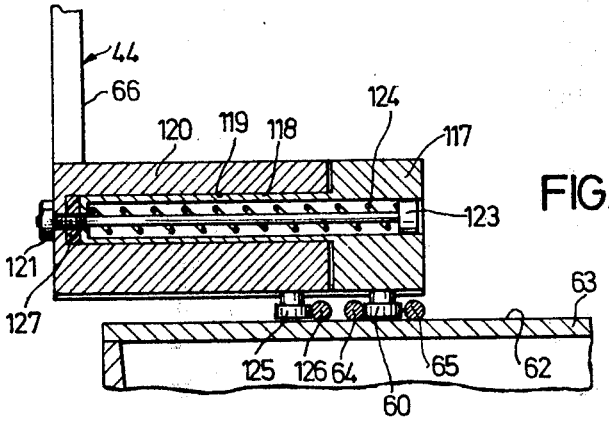
FIGs. 11 and 12 illustrate details of the movement control of the folding blade or sword of the embodiment of FIGS. 6 to 10.
Figure 12:
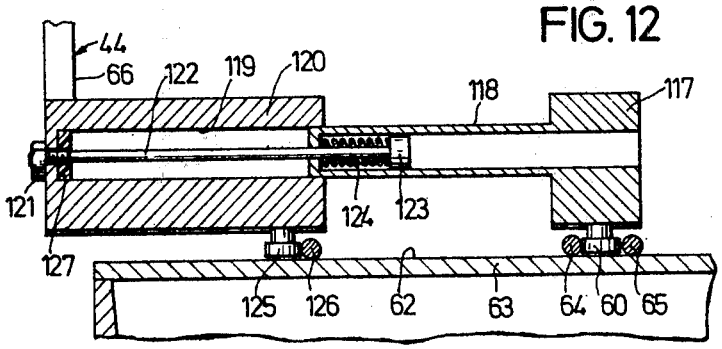
Figure 8:
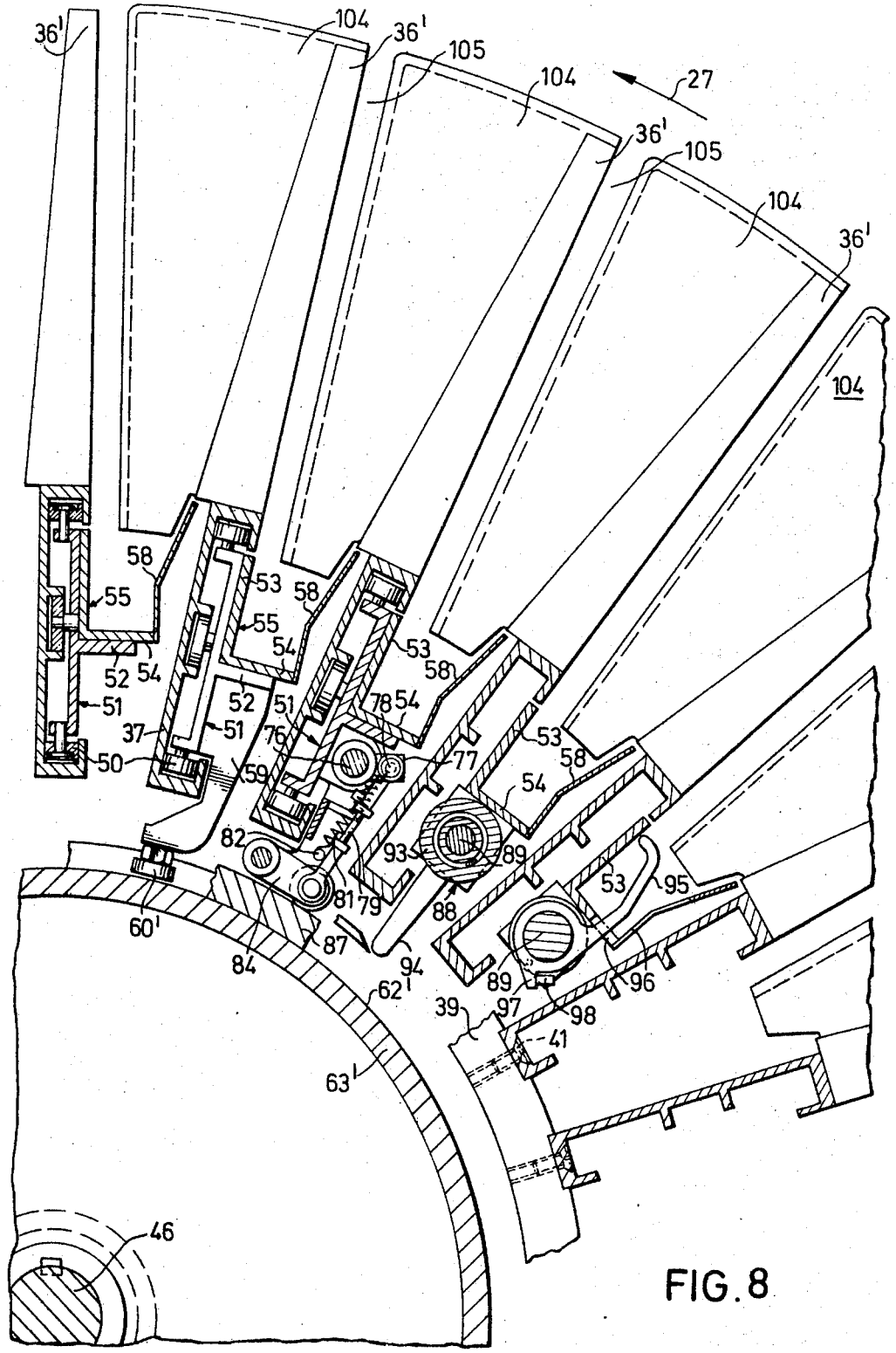
FIG. 8 illustrates on an enlarged scale sections through the starting region of individual compartments of the cell wheel of the apparatus according to FIGS. 6 and 7, the sections being axially offset from compartment to compartment, for instance approximately in the manner of the showing of FIG. 4.

On the basis of FIGS. 11 and 12 there now will be described the mechanism which initially holds in arrested position the folding blade 44 prior to the start of its work stroke, while the follower element 60, at which there is coupled the folding blade 44, already has begun the work stroke. There will be recognized in FIGS. 11 and 12 the drum 63 at the jacket or outer surface 62 of which there are welded both of the round profiles or profile members 64, 65 which constitutes the guide track. Between the round profile members 64 and 65 there engages the rotatable roll 60. Such is rotatably mounted at a carriage 117 displaceable guided in the profile rail 37 (not visible in the showing of FIGS. 11 and 12). A guide sleeve 118 extends from the carriage 117 parallel to the axis of the cell wheel. This guide sleeve 118 displaceably engages into a coaxial bore 119 in a second carriage 120 which is likewise displaceable in the profile rail 37. The folding blade 44 is attached to this carriage 120. Attached also to the carriage 120 by means of a nut member 121 or equivalent structure is a traction rod 122 engaging coaxially through the bore 119, traction rod 112 further engaging by means of its free end into the interior of the guide sleeve 118 closed at one end and at that location carrying a support piston 123. Between the support piston 123 and the closed free end of the guide sleeve 118 there is spanned a pressure or compression spring 124. The compression spring 124 strives to hold together both of the carriges 117 and 120 in the position shown in FIG. 11. Extending from the carriage 120 in the direction of the drum 63 is a further rotatable roller or roll 125 which at the end of the return stroke of both carriages 117 and 120 engages behind a further circular profile member 126 welded to the jacket surface 62 of the drum 63. The circular profile member 126 describes, however, only a small segment of the diameter of the drum 62, thus possesses in contrast to the circular profile members 64 and 65 no pitch. During the rotation of the cell wheel the roller 125 and therefore the carriage 120 and the folding blade 44 thus remain in the same position until the roller 125 has reached the end of the circular profile member 126. Thereafter the carriage 120 is immediately exposed to the action of the compression spring 124 which in the meantime has been spanned or biased by the axial displacement of the carriage 117. The carriage 120 thus begins its work stroke with a considerably greater speed than would be possible merely by virtue of the pitch of the guide track 61 and both of the circular profile members 64, 65. In order to insure that the end of the guide sleeve 118 does not suddenly impact against the floor of the bore 119 a buffer or damper 127 is provided thereat. Additionally, the movement brought about by the compression spring 124 is somewhat dampened in that the guide sleeve 118 displaces like a piston in the bore 119 and thus must displace the air entrapped at that location.

While there are shown and described present preferred embodiments of the invention, it is to be distinctly understood that the invention is not limited thereto, but may be otherwise variously embodied and practiced within the scope of the following claims.

Accordingly, what is claimed is:

1. An apparatus for folding products, especially printed products, comprising a cell wheel, means for rotatably driving the cell wheel, said cell wheel incorporating means for providing a plurality of compartments each of which is capable of receiving a respective printed product to be folded, a folding blade provided for each compartment for folding of the product located therein, means for driving to-and-fro the folding blade between a work stroke and a return stroke in axial direction of the cell wheel, a common stationarily arranged folding rail provided for all of the compartments for bending part of each product about the folding blade of the compartment in which such product is located, contact means arranged in each compartment cooperating with the associated folding blade of such compartment for completing the folding of the product in such compartment, the folding blade prior to the start of its work stroke moving past the common folding rail and during the course of its work stroke moving past said contact means arranged in each of the compartments with its folding blade side which trails with respect to the direction of rotation of the cell wheel, and infeed means for delivering a printed product to a leading side of the folding blade prior to the start of its work stroke in each compartment.

2. The apparatus as defined in claim 1, wherein the contact means comprises a contact rail.

3. The apparatus as defined in claim 1, wherein the contact means comprises a contact drum.

4. The apparatus as defined in claim 1, wherein each folding blade possesses a folding edge extending essentially parallel to the lengthwise axis of the cell wheel.

5. The apparatus as defined in claim 1, wherein the infeed means for each of the compartments comprises controlled grippers which can be moved to-and-fro in synchronism with the folding blade in a work stroke and a return stroke along the compartments.

6. The apparatus as defined in claim 5, wherein each folding blade possesses a folding edge extending essentially parallel to the lengthwise axis of the cell wheel, grippers provided for each compartment, the folding blade and the grippers being secured at a component forming the floor of a compartment and movable to-and-fro along such compartment.

7. The apparatus as defined in claim 6, further including guide track means forming a closed curve and common to all the compartments, the component carrying the folding blade and the grippers of each of the compartments engaging by means of a follower element in the guide track means.

8. The apparatus as defined in claim 7, wherein the guide track is formed at the outer surface of a drum which is substantialy coaxially arranged with respect to the lengthwise of the cell wheel, the outer diameter of said drum being smaller than the diameter of the revolving path of travel of the floors of the compartments.

9. The apparatus as defined in claim 5, wherein the infeed means comprises an infeed conveyor which delivers the printed products individually to the grippers prior to the start of their work stroke.

10. The apparatus as defined in claim 1, wherein the means forming the compartments of the cell wheel comprise bounding partition walls extending essentially parallel to the lengthwise axis of the cell wheel, each partition wall having a cut-out into which engages the folding rail during the course of the rotational movement of the cell wheel.

11. The apparatus as defined in claim 1, wherein the folding blade has a folding edge which extends essentially at right-angles to the lengthwise axis of the cell wheel.

12. The apparatus as defined in claim 11, wherein the infeed means for each of the compartments comprises controlled grippers which are displaceably driven to-and-fro along an associated compartment in a work stroke and a return stroke in non-synchronism with the folding blade.

13. The apparatus as defined in claim 12, wherein the infeed means comprises an infeed conveyor which delivers the printed products individually to the grippers prior to the start of their work stroke.

14. The apparatus as defined in claim 12, wherein the work stroke of the grippers is shorter than that of the folding blade.

15. The apparatus as defined in claim 12, further including a follower element at which there are coupled the grippers of each of the compartments, a guide track forming a closed curve common for all compartments with which engages the follower element.

16. The apparatus as defined in claim 15, further including a follower element with which there is coupled the folding blade, a guide track forming a closed curve and common to all of the compartments, the follower element engaging with said guide track.

17. The apparatus as defined in claim 16, wherein both of the guide tracks are each formed at the outer surface of a drum which is coaxially arranged with respect to the lengthwise axis of the cell wheel, the outer diameter of both of the drums being smaller than the diameter of the revolving path of travel of the floors of the compartments.

18. The apparatus as defined in claim 17, wherein the work stroke of the grippers is shorter than that of the folding blade.

19. The apparatus as defined in claim 17, wherein both drums possess substantially the same external diameter.

20. The apparatus as defined in claim 16, further including a spring for coupling the folding blade with the follower element, stop means for periodically fixedly holding the folding blade at the end of its return stroke while the follower element already carries out its work stroke.

21. The apparatus as defined in claim 1, wherein the contact means comprises a contact rail embodying a bent folding bracket arranged so as to be axially non-displaceable in each compartment, the folding bracket, with respect to the folding blade during the course of its axial displacement, extending with play from a leading side of such folding blade over a folding edge thereof towards a trailing side of such folding blade.

22. An apparatus for folding products, especially printed products, comprising a cell wheel, means for rotatably driving the cell wheel, said cell wheel incorporating a plurality of compartments each of which is capable of receiving a product to be folded, a folding blade for each compartment for folding of the product located therein, means for driving to-and-fro the folding blade between a work stroke and a return stroke in axial direction of the cell wheel, a common stationarily arranged folding rail provided for the compartments for initiating folding of each product about its associated folding blade, the folding blade prior to the start of its work stroke moving past the common folding rail, product contact means arranged in each of the compartments and cooperating with the folding blade of the associated compartment for completion of folding of the product in the associated compartment, and infeed means for delivering a product to a folding blade prior to the start of its work stroke in its compartment.

* * * * *